US007725050B2

(12) United States Patent
Li et al.

(10) Patent No.: US 7,725,050 B2
(45) Date of Patent: May 25, 2010

(54) HEATED DRUM ASSEMBLY HAVING A MULTIPLE SPEED FAN FOR USE IN A PRINTER

(75) Inventors: Faming Li, Penfield, NY (US); Eric Scott Hamby, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 77 days.

(21) Appl. No.: 12/234,214

(22) Filed: Sep. 19, 2008

(65) Prior Publication Data

US 2010/0073417 A1 Mar. 25, 2010

(51) Int. Cl.

| | |
|---|---|
| ***G03G 21/20*** | (2006.01) |
| ***B41J 2/01*** | (2006.01) |
| *B41J 29/38* | (2006.01) |
| *F24F 11/053* | (2006.01) |

(52) U.S. Cl. ..... 399/96; 399/69; 399/92; 347/17; 347/103; 219/470; 236/1 B

(58) Field of Classification Search ..... 399/69, 399/92, 96

See application file for complete search history.

(56) References Cited

U.S. PATENT DOCUMENTS

| | | | | |
|---|---|---|---|---|
| 5,787,321 | A * | 7/1998 | Nishikawa et al. | 399/69 |
| 6,185,836 | B1 | 2/2001 | Zaoralek | |
| 6,567,629 | B2 | 5/2003 | Anderson et al. | |
| 7,054,572 | B2 | 5/2006 | Baruch et al. | |
| 2003/0165345 | A1 * | 9/2003 | Chikano | 399/92 |
| 2003/0210922 | A1 * | 11/2003 | Serizawa et al. | 399/96 |
| 2008/0298831 | A1 * | 12/2008 | VanKouwenberg et al. | 399/92 |

FOREIGN PATENT DOCUMENTS

| | | | |
|---|---|---|---|
| JP | 2002072764 A | * | 3/2002 |
| JP | 2006010932 A | * | 1/2006 |

* cited by examiner

*Primary Examiner*—Matthew Luu
*Assistant Examiner*—Shelby Fidler
(74) *Attorney, Agent, or Firm*—Maginot, Moore & Beck LLP

(57) ABSTRACT

A heated drum assembly improves thermal control of a rotating drum in a printer. The assembly includes a hollow drum, two stationary heaters located within an internal cavity of the drum, one of the two stationary heaters being at one end of the drum and the other stationary heater being at another end of the drum, a fan located at one end of the drum, a temperature sensor at one end of the drum, and a second temperature sensor at the other end of the drum, and a controller electrically coupled to the heaters, the fan, and the two temperature sensors to control a temperature of the wall of the drum to a set point by activating at least one of the heaters in response to a signal indicating a temperature below a first predetermined temperature threshold and operating the fan at one of three speeds.

19 Claims, 5 Drawing Sheets

HEATED DRUM ASSEMBLY HAVING A MULTIPLE SPEED FAN FOR USE IN A PRINTER

TECHNICAL FIELD

This disclosure relates to imaging devices having rollers heated with multiple heaters and, more particularly, to imaging devices having image receiving members that are heated with multiple heaters.

BACKGROUND

Imaging devices use a variety of marking materials to generate a physical image of an electronic image. The materials include, for example, aqueous ink, melted ink, and toner. The marking material may be ejected onto or developed on an image receiving member. For example, electronic image data may be used to generate a latent image on a photoreceptor belt and then the latent image is developed with toner material in a development station. With aqueous ink or melted ink, a print head ejects the melted ink onto an image receiving member. The firing of the ink jets in the print head to deposit the material on the image receiving member is manipulated by a print head controller using electronic image data.

After the marking material is deposited onto an image receiving member, the image may be transferred or transfixed to an image media. For example, a sheet or web of image media may be moved into a nip formed between the image receiving member and a transfix or fuser roller so the image may be transferred to the image media. The movement of the image media into the nip is synchronized with the movement of the image on the image receiving member so the image is appropriately aligned with and fits within the boundaries of the image media. The pressure within the nip helps transfix or fuse the marking material onto the image media.

The image receiving member is typically heated to improve compatibility of the image receiving member with the inks deposited on the member. The image receiving member may be, for example, an anodized and etched aluminum drum. Within the drum, a heater reflector may be mounted axially within the drum. A heater is located at approximately each end of the reflector. The heater reflector remains stationary as the drum rotates. Thus, the heaters apply heat to the inside of the drum as the drum moves past the heaters on the reflector. The reflector helps direct the heat towards the inside surface of the drum. Each of the heaters is coupled to a controller. The controller is also coupled to temperature sensors located near the outside surface of the drum. The controller selectively operates the heaters to maintain the temperature of the outside surface within an operating range.

Differences in temperatures of the components interacting during a print cycle cause thermal gradients to appear sometimes across the outside surface of the image drum. For example, the controller operates the heaters in an effort to maintain the temperature of the outside surface in a range of about 55 degrees Celsius, plus or minus 5 degrees Celsius. The ink that is ejected onto the print drum has a temperature of approximately 110 to approximately 120 degrees Celsius. Thus, images having areas that are densely pixilated, may impart a substantive amount of heat to a portion of the print drum. Additionally, the drum experiences convective heat losses as the exposed surface areas of the drum lose heat as the drum rapidly spins in the air about the drum. Also, the contact of the recording media with the print drum also affects the surface temperature of the drum. For example, paper placed in a supply tray has a temperature roughly equal to the temperature of the ambient air. As the paper is retrieved from the supply tray, it moves along a path towards the transfer nip. Typically, this path includes a media pre-heater that raises the temperature of the media. These temperatures may be approximately 40 degrees Celsius. Thus, when the media enters the transfer nip, areas of the print drum having relatively few drops of ink on them are exposed to the cooler temperature of the media. Consequently, densely pixilated areas of the print drum are likely to increase in temperature, while more sparsely covered areas are likely to lose heat to the passing media. These differences in temperatures result in thermal gradients across the print drum.

Efforts have been made to control the thermal gradients across a print drum for the purpose of maintaining the surface temperature of the print drum within the operating range. Simply controlling the heaters is insufficient because the ejected ink may raise the surface temperature of the print drum above the operating range even though the heater in that region is off. To provide cooling, a fan has been added at one end of a print drum. The print drum is open at each flat end of the drum. To best provide cooling, the fan is located outside the print drum and is oriented to blow air from the end of the drum at which the fan is located to the other end of the drum where it is exhausted. The fan is electrically coupled to the controller so the controller activates the fan in response to one of the temperature sensors detecting a temperature exceeding the operating range of the print drum. The air flow from the fan eventually cools the overheated portion of the print drum and the controller deactivates the fan.

While the fan system described above works for maintaining the temperature of the drum within an operating range, it possess some inefficiencies. Specifically, inefficiency arises when the surface portion of the print drum at which the air flow is exhausted from the print drum has a higher temperature than the surface area near the end of the print drum at which the fan is mounted. In response to the higher temperature detection, the controller activates the fan. As the cooler air enters the drum, it absorbs heat from the area near the fan that is within operating range. This cooling may result in the controller turning on the heater for that region to keep that area from falling below the operating range. Even though the air flow is heated by the region near the fan and/or the heater in that area, it still is able to cool the overheated area near the drum end from which the air flow is exhausted eventually. Nevertheless, the energy spent warming the region near the fan and the additional time required to cool the overheated area with the warmed air flow from the fan adds to the operating cost of the printer. Therefore, more efficient cooling of the print drum would be useful.

SUMMARY

To address the issues arising from inefficiency in cooling overheated areas of an image receiving member in a printer, a heated drum assembly has been developed that aids in selectively cooling a portion of an image receiving member. The heated drum assembly includes a hollow drum having a circumferential wall that defines an outer boundary for an internal cavity, the hollow drum having a first end and a second end and a longitudinal axis about which the hollow drum rotates, at least two stationary heaters that are located within the internal cavity of the hollow drum to heat the circumferential wall as it passes by the heaters, one of the two stationary heaters being located near one end of the hollow drum and the other stationary heater being located near the other end of the hollow drum, a fan located at one of the two ends of the hollow drum, at least two temperature sensors, one temperature sensor being located proximate one of the two ends of the hollow drum, and the other temperature sensor being located proximate the other of the two ends of the hollow drum, each sensor generating a signal indicative of a temperature proximate the temperature sensor, and a controller coupled to the heaters, the fan, and the two temperature sensors, and configured to control a temperature of the circumferential wall of the drum to a set point, the controller activating at least one of the heaters in response to a signal from at least one of the temperature sensors indicating a temperature below a first predetermined temperature threshold, and operating the fan at one of at least three speeds in response to a predetermined relationship between the two temperature signals generated by the temperature sensors and a second predetermined threshold.

A method of controlling a multi-speed fan in a drum assembly helps ensure a more uniform distribution of temperature across a heated image receiving member. The method includes detecting a temperature at a first portion of a heated image receiving member exceeding a predetermined temperature threshold, detecting a temperature at a second portion of the heated image receiving member exceeding the predetermined temperature threshold, alternating operation of a fan directing air through the heated image receiving member between a first speed and a second speed for predetermined periods of time in response to the first portion of the heated image receiving member and the second portion of the heated image receiving member being detected as having a temperature exceeding the predetermined temperature threshold.

DETAILED DESCRIPTION

Figure 1:
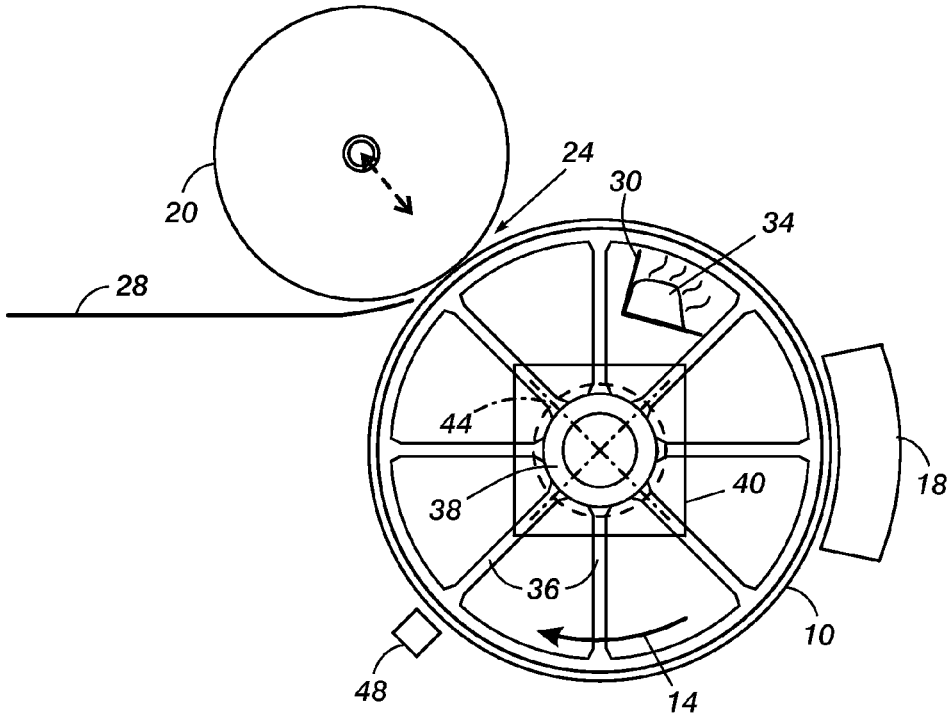
FIG. 1 is a side view of a printer showing an image receiving member and the relationship of cooling system components to the image receiving member.

FIG. 1 is a side view of a printer showing major components for forming an image and a portion of the cooling system for an image receiving member. The printer includes an image drum 10 that receives melted ink ejected by a print head 18 as the drum rotates in the direction 14. One or more revolutions of the drum 10 are required before an image is formed on the drum. A transfer or transfix roller 20 is displaceable towards and away from the drum 10 to form a nip 24 between them in a selective manner. Formation of the nip 24 is synchronized with the approach of the image on the print drum 10 to the area between the transfer roller 20 and the print drum 10. A media path 28 supports recording media and directs a media sheet into the nip 24. Delivery of recording media to the nip 24 is also synchronized with the approach of an image towards the transfer roller 20. After the media sheet passes through the nip to receive an image from the image receiving member 10, the media exits the nip and is directed to an output tray at the end of the media output path (not shown).

The image drum 10 includes a heat reflector 30 into which a heater 34 is mounted. The reflector 30 and heater 34 remain fixed as drum 10 rotates past the heater 34. The heater 34 generates heat that is absorbed by the inside surface of the drum 10 to heat the image receiving drum as it rotates past the heater. Although the heater 34 is shown as being located so it heats the inside surface of the drum, it may also be located externally of the drum to heat the external surface. A cooling system for the drum 10 includes a hub 38 that is preferably centered about the longitudinal center line of the image drum 10. A fan 40 is mounted outboard of the hub 38 and oriented to direct air flow through the drum. A temperature sensor 48 is located proximate the outer surface of the drum 10 to detect the temperature of the drum surface as it rotates.

In more detail, the drum 10 may be, for example, an aluminum drum that has been anodized and etched. Other image receiving members, however, may be used with the cooling system disclosed herein. Each end of the drum 10 may be open with a hub 38 and spokes 36 as shown in FIG. 1. The hub may be provided with a pass through for passage of electrical wires to the heater(s) within the drum. Additionally, the hub has a bearing at its center so the drum may be mounted about the hub for rotation within a printer. The spokes 36 extend from the hub 38 to support the cylindrical wall of the drum 10 and provide airways for air circulation in the drum 10. The heater 34 that heats the drum 10 may be a convective or radiant heater. The fan 40 may be a muffin fan or other conventional electrical fan. For most typical printing applications, the fan 40 should produce air flow in the range of approximately 45-55 cubic feet per minute (CFM) of air flow, although other airflow ranges may be used depending upon the thermal parameters of a particular application.

The temperature sensor 48 may be any type of temperature sensing device that generates an analog or digital signal indicative of a temperature in the vicinity of the sensor. Such sensors include, for example, thermistors or other junction devices that predictably change in some electrical property in response to the absorption of heat. Other types of sensors include dissimilar metals that bend or move as the materials having different coefficients of temperature expansion respond to heat.

Figure 2:
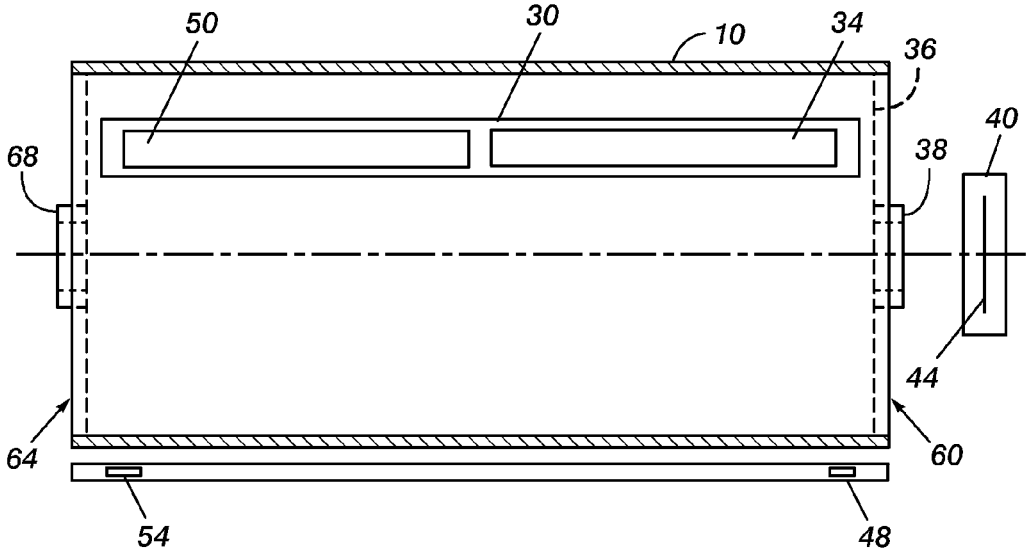
FIG. 2 is a front view of the image receiving member shown in FIG. 1.

A cross-sectional view of the drum 10 through the center of the hub 38 is shown in FIG. 2. The drum 10 has a longitudinal axis running through the center of the hub 38 at the first end 60 and through the center of the hub 38 at a second end 64. The second end 64 also includes a hub 68 from which spokes 36 also extend to support the cylindrical wall of the drum 10. The voids between the spokes 36 at each end of the drum 10 facilitate air flow through the drum 10. Within the reflector 30 is mounted another heater 50. The heater 34 heats a first portion of the drum 10 and the heater 50 heats a second portion of the drum 10. Other heaters may be mounted within the reflector 30 if more localized area control of the drum heating is required. Also, a second temperature sensor 54 is mounted proximate the second end 64 to sense the temperature near the second end of the drum 10. Additional temperature sensors may be mounted about the drum 10; however, the temperature sensors are preferably mounted in a linear arrangement as shown in FIG. 2. Although the temperature sensors are shown as being located near the ends of the drum 10, they may be located closer towards the center of the drum along the longitudinal axis of the drum.

Fan 40 is a multi-speed fan. That is, the speed of fan rotation depends upon the magnitude or the frequency of the drive signal generated by the controller for the fan 40. In one embodiment, the fan 40 may be operated at three speeds: off, slow, and fast. When the blade 44 rotates at the slow speed, the slow moving air disperses from the discharge column and strikes the internal wall of the drum 10 closer to the end of the drum at which the fan is located. Eventually, the air flows through the drum 10 to the end 64 where it is exhausted. When the blade 44 rotates at the faster speed, air flows through the central portion of the drum along the longitudinal axis a greater distance before dispersing towards the internal wall of the drum 10. Thus, the faster airflow affects the temperature of the drum at the end 64 more than it does the temperature of the drum at the end 60.

Figure 3:
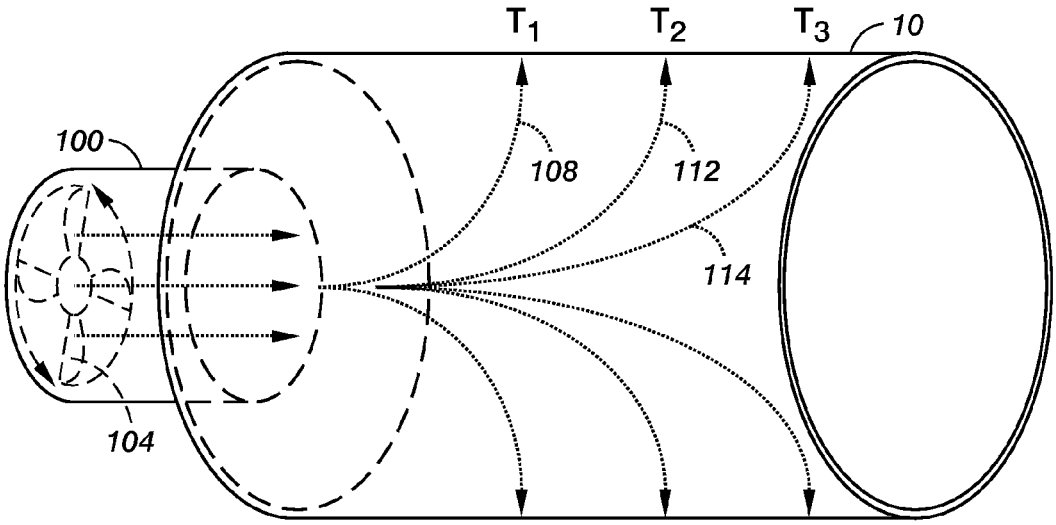
FIG. 3 is a side view of an alternative embodiment of the cooling system shown in FIG. 1 and FIG. 2.

In another embodiment shown in FIG. 3, an air director 100 surrounds the discharge area of the fan 104. The air director 100 may be a fan shroud or the like with an extension that collects and directs the discharge of the fan along the longitudinal axis of the drum 10. The air director 100 retards the dispersion of the airflow from the fan 104 to preserve the integrity of the air column from the fan for a longer period of time. Additionally, fan 104 is a four speed fan, namely, off, slow, faster, and fast. These speeds are selected to correspond to pushing the air column from the fan to a position where the dissipation of the column towards the internal of the drum occurs at one of the positions 108, 112, or 114. Again, the delay in the dispersion of the air column selectively directs the discharge of the fan towards a particular section of the drum to target a specific area for cooling. Selection of the fan speed is discussed in more detail below.

Figure 4:
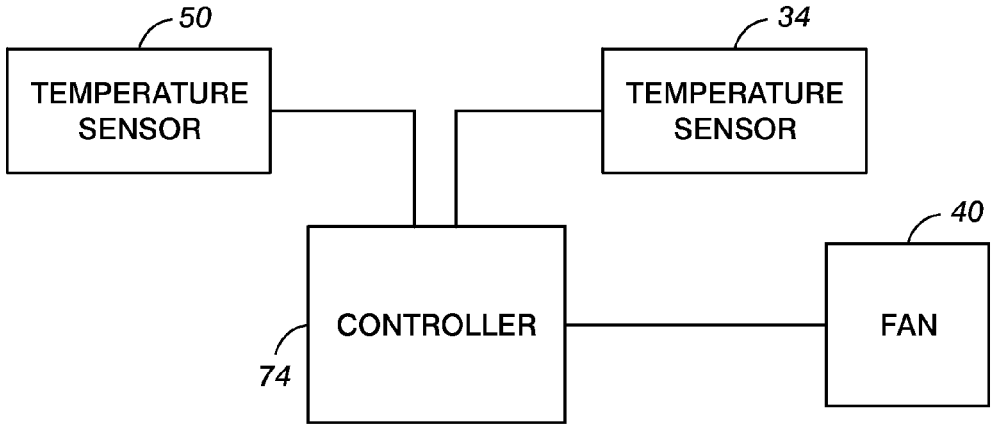
FIG. 4 is a block diagram of a cooling system that improves energy efficiency for cooling the image receiving member shown in FIG. 1.

A block diagram for one embodiment of the cooling system is shown in FIG. 4. The cooling system 70 includes a controller 74, the temperature sensors 34, 50, and the fan 40. The controller 74 may be a general purpose microprocessor that executes programmed instructions stored in a memory or it may be an application specific integrated circuit (ASIC). Alternatively, the controller 74 may be implemented with discrete electronic components or with a combination of programmable components and discrete components. The signals from sensors 34, 50 may be analog signals that are digitized by an A/D converter, which is interfaced to the controller 74. The controller 74 receives temperature values from the temperature sensors 34, 50 and compares those values to thresholds using programmed instructions. The controller 74 may be configured to detect whether one or both of the temperatures are greater than one or more thresholds for operation of the heaters and the fan. With regard to operation of the heaters, the controller 74 may be configured to activate a heater in response to a temperature sensed by a temperature sensor close to the heater being less than a first predetermined temperature threshold. In this manner, if a portion of the drum wall falls below the first temperature threshold, the heater is activated to heat the wall portion passing by the heater. If both temperature sensors detect a temperature that is less than the first predetermined temperature threshold, both heaters are activated. In response to a temperature being detected that exceeds a second predetermined temperature threshold, the heater closest to the sensor detecting that temperature is deactivated. The second predetermined temperature threshold is greater than the first predetermined temperature threshold.

In the drum assembly described herein, the controller may also be configured to operate the fan to help regulate the temperatures being sensed by the temperature sensors. If only one temperature sensor generates a signal indicating a temperature near the sensor is greater than the second predetermined temperature threshold, then the controller 74 operates the fan 40 at a speed that disperses the fan discharge towards the portion of the internal wall near the temperature sensor sensing the temperature that exceeds the second predetermined temperature threshold. If both temperatures are detected as exceeding the second predetermined temperature threshold, the controller alternates the operation of the fan between the slow speed and the fast speed for predetermined periods of time. For example, the controller may operate the fan at the slow speed for X seconds and then operate the fan at the high speed for Y seconds. While the periods of time for operation of the fan at the various speeds may be different, they may also be equal. This alternating operation of the fan at these different speeds continues until one or both of the temperature sensors detects a temperature that is less than or equal to the second predetermined temperature threshold. The controller 74 then operates the fan as described above in response to one of the two sensors detecting a temperature that exceeds the second predetermined temperature. Once neither of the two temperature sensors detects a temperature exceeding the second predetermined temperature threshold, the controller 74 turns off the fan.

The reader may ascertain from the above description that the controller is configured to cool the portion of the drum wall that exceeds the second predetermined threshold; however, if all of the temperature sensors detect a temperature that exceeds the predetermined threshold, then the controller operates the fan in a manner that directs cooling air towards different portions of the drum wall at different times. Moreover, operating the heats with reference to the first predetermined threshold helps prevent the heaters from being operated at the same time that the fan is also operated. Thus, energy is conserved as simultaneous operation of a heater and a fan is avoided.

Figure 5:
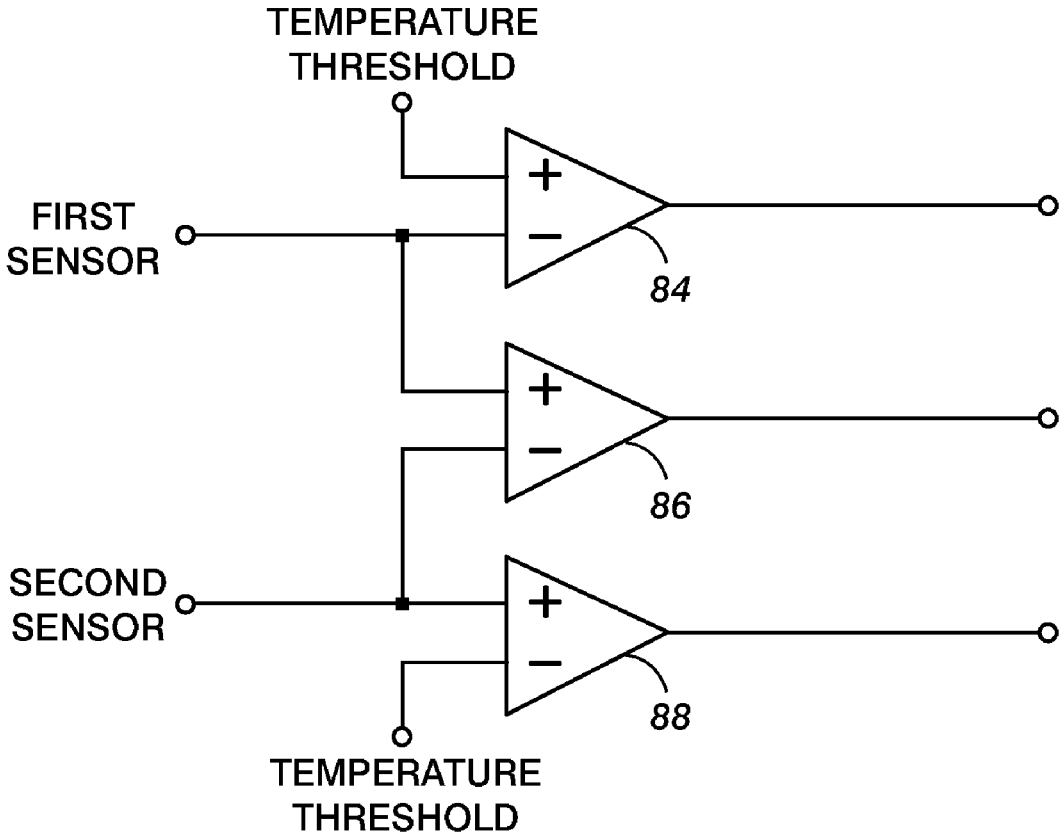
FIG. 5 is a schematic of a temperature comparator that may be used in the cooling system.

In another embodiment, the temperature comparators may be implemented in a temperature comparator circuit. An exemplary temperature comparator circuit is shown in FIG. 5. The temperature comparator circuit 80 includes two differential amplifiers configured to operate as comparators. The comparator 84 compares the temperature signal from the first temperature sensor to a temperature threshold and the comparator 88 compares the temperature signal from the second temperature sensor to the temperature threshold. The signal output by the comparator 84 indicates whether the temperature sensed by the first temperature sensor 34 is greater than the temperature threshold and the signal output by the comparator 88 indicates whether the temperature sensed by the second temperature sensor 50 is greater than the temperature threshold. The comparator 86 compares the first temperature signal to the second temperature signal to determine which one is greater. The threshold may be either the first predetermined temperature threshold or the second predetermined temperature threshold.

The controller 74 may be configured to receive the three signals described with reference to FIG. 5 and determine the speed or the duration of a time period during which the fan is operated at a particular speed. For example, detection that only one sensor detects a temperature greater than the second predetermined temperature threshold can result in the fan being operated at one speed as described above. If comparators 84 and 88 indicate both sensors are detecting a temperature that is greater than the second predetermined temperature threshold, then the output of comparator 86 may be used to operate the fan for a longer period of time at the speed that directs air towards the wall portion proximate the sensor detecting the warmer temperature than the time that the fan is operated at the speed that directs air towards the cooler wall portion.

Figure 6:
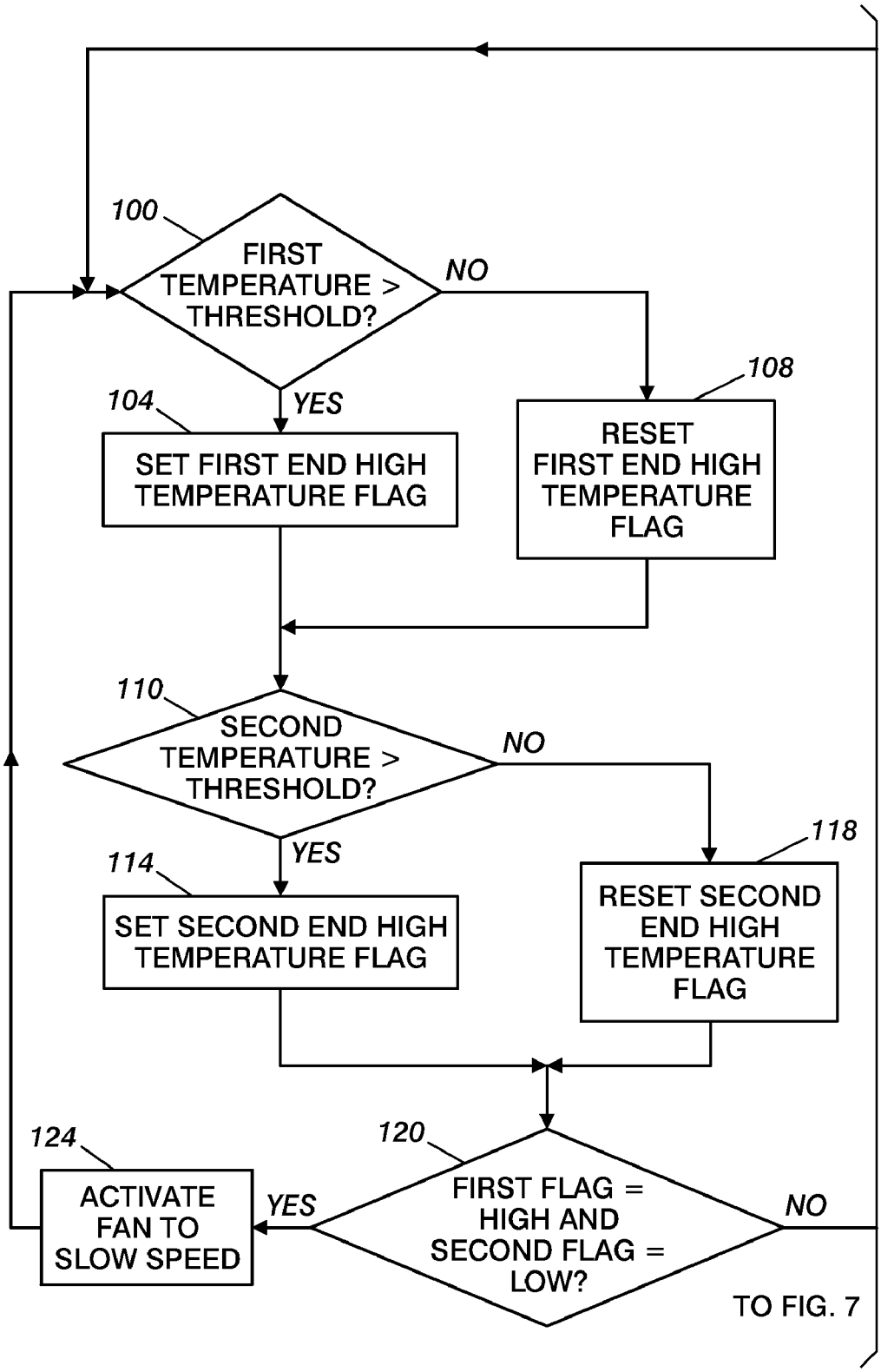
FIG. 6 and FIG. 7 comprise a flow diagram of a method for cooling an image receiving member.
Figure 7:
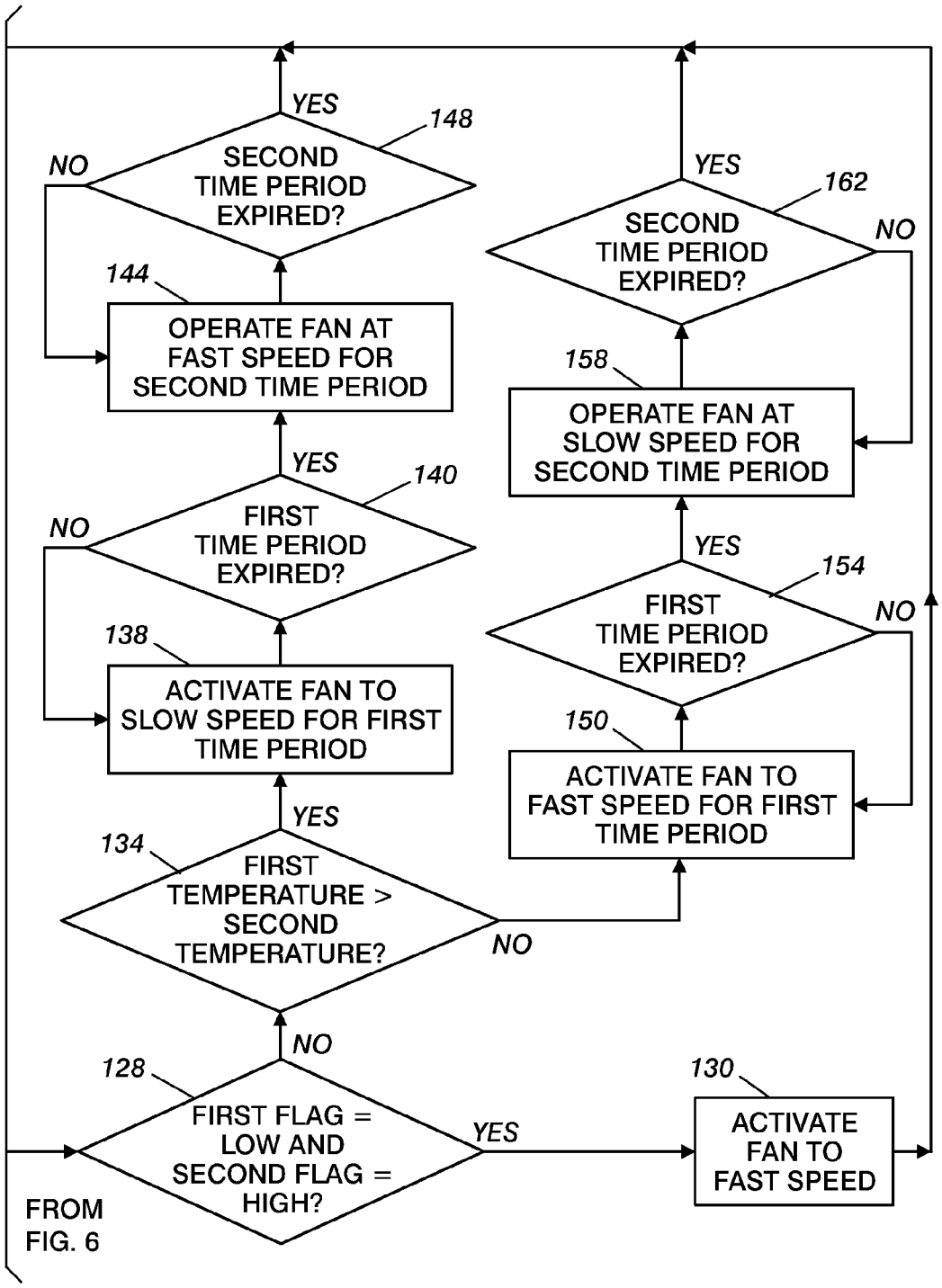

The controller may be configured to operate a fan in a manner that improves the efficiency of the drum cooling process over processes previously known. An exemplary method of operation for a controller configured to control a fan with reference to signals generated by at least a pair of temperature sensors in a drum assembly is shown in FIG. 6 and FIG. 7. The process detects whether a temperature sensed by a first temperature sensor is greater than the second predetermined temperature threshold (block 100). If the temperature is greater than the second predetermined temperature threshold, the first end high temperature flag is set (block 104). Otherwise, the first end high temperature flag is reset (block 108). The process then detects whether a temperature sensed by the second temperature sensor is greater than the second predetermined temperature threshold (block 110). If the temperature is greater than the threshold, the second end high temperature flag is set (block 114). Otherwise, the second end high temperature flag is reset (block 118). If the first end high temperature flag is set and the second end high temperature flag is reset (block 120), then the fan is activated to move air at the slow speed (block 124). The process then continues to monitor the temperatures sensed by the sensors (block 100).

The remainder of the process is discussed with reference to FIG. 7. If the second end high temperature flag is set and the first end high temperature flag is reset (block 128), then the second fan is activated to move air at the high speed (block 130). The process then continues to monitor the temperatures sensed by the sensors (block 100). If the first end high temperature flag and the second end high temperature flag are not different, then both flags have been set. In response to this condition, the process determines which detected temperature is higher (block 134). If the first temperature is higher, then the fan is activated to move air at the slow speed for a first time period (block 138). Upon expiration of the first time period (block 140), the fan is operated at the fast speed for a second time period (block 144). Upon expiration of the second time period (block 148), the process continues to monitor the temperature sensors (block 100). If the second temperature is higher (block 134), then the fan is activated at the high speed (block 154). Upon expiration of the first time period (block 154), the fan is operated at the fast speed for a second time period (block 158). Upon expiration of the second time period (block 162), the process continues to monitor the temperature sensors (block 100) (FIG. 6).

In operation, a drum assembly is configured with the two temperature sensors and a multi-speed fan as described above. The fan and temperature sensors are coupled to the controller and the controller is configured with programmed instructions and related circuitry to implement a method for operating the fan in response to one or both of the temperature sensors detecting a temperature exceeding a second predetermined temperature threshold that is greater than a first predetermined temperature threshold used by the controller to operate the heaters in the drum assembly. In response to one of the temperature sensors detecting a temperature that exceeds the second predetermined temperature threshold, the controller operates the fan at a speed that directs air to the portion of the drum wall closest to the temperature sensor detecting the temperature that exceeds the second predetermined temperature threshold. In response to both of the temperature sensors detecting a temperature that exceeds the second predetermined temperature threshold, the controller operates the fan at a first speed for a first period of time that directs air to the portion of the drum wall closest to the temperature sensor detecting the warmest temperature that exceeds the second predetermined temperature threshold and then operates the fan at a second speed for a second period of time that directs air to the portion of the drum wall closest to the temperature sensor detecting the cooler temperature that exceeds the second predetermined temperature threshold. If the temperature sensed by only one of the temperature sensors drops below the second predetermined temperature threshold, the controller operates in response to the single temperature exceeding the threshold as described above. Once both temperatures drop below the second predetermined temperature threshold, the controller turns off the fan.

It will be appreciated that various of the above-disclosed and other features and functions, or alternatives thereof, may be desirably combined into many other different systems or applications. Various presently unforeseen alternatives, modifications, variations, or improvements therein may be subsequently made by those skilled in the art which are also intended to be encompassed by the following claims.

What is claimed is:

1. A heated drum assembly for use in a printer, the drum assembly comprising:

a hollow drum having a circumferential wall that defines an outer boundary for an internal cavity, the hollow drum having a first end and a second end and a longitudinal axis about which the hollow drum rotates;

at least two stationary heaters that are located within the internal cavity of the hollow drum to heat the circumferential wall as it passes by the heaters, one of the two stationary heaters being located near one end of the hollow drum and the other stationary heater being located near the other end of the hollow drum;

a fan located at one of the two ends of the hollow drum and configured to direct air through the hollow drum;

at least two temperature sensors, one temperature sensor being located proximate one of the two ends of the hollow drum, and the other temperature sensor being located proximate the other of the two ends of the hollow drum, each sensor generating a signal indicative of a temperature proximate the temperature sensor; and a controller coupled to the heaters, the fan, and the two temperature sensors, and configured to control a temperature of the circumferential wall of the drum to a set point, the controller activating at least one of the heaters in response to a signal from at least one of the temperature sensors indicating a temperature below a first predetermined temperature threshold, and operating the fan at one of at least three speeds in response to a predetermined relationship between the two temperature signals generated by the temperature sensors and a second predetermined threshold.

2. The drum assembly of claim 1 wherein the controller is configured to operate the fan at a slow speed in response to the temperature sensor located at the end of the hollow drum where the fan is located generating a signal indicative of a temperature exceeding the second predetermined threshold and the other temperature sensor generating a signal indicative of a temperature that is equal to or below the second predetermined threshold.

3. The drum assembly of claim 2 wherein the controller operates the fan at a fast speed in response to the temperature sensor located at the end of the hollow drum where the fan is located generating a signal indicative of a temperature equal to or less than the second predetermined threshold and the other temperature sensor generates a signal indicative of a temperature exceeding the second predetermined threshold.

4. The drum assembly of claim 3 wherein the controller operates the fan at an off speed in response to both temperature sensors generating a signal indicative of a temperature being equal to or less than the second predetermined threshold.

5. The drum assembly of claim 3 wherein the controller alternates operation of the fan between the slow speed and the high speed for predetermined periods of time in response to both temperature sensors generating a signal indicative of a temperature exceeding the second predetermined threshold.

6. The drum assembly of claim 1 wherein the controller alternates operation of the fan between a slow speed and a high speed for predetermined periods of time in response to both temperature sensors generating a signal indicative of a temperature exceeding the second predetermined threshold.

7. The drum assembly of claim 6 wherein the controller operates the fan at the fast speed in response to the temperature sensor located at the end of the hollow drum where the fan is located generating a signal indicative of a temperature equal to or less than the second predetermined threshold and the other temperature sensor generates a signal indicative of a temperature exceeding the second predetermined threshold.

8. The drum assembly of claim 7 wherein the controller operates the fan at an off speed in response to both temperature sensors generating a signal indicative of a temperature being equal to or less than the second predetermined threshold.

9. The drum assembly of claim 8 wherein the controller is configured to operate the fan at the slow speed in response to the temperature sensor located at the end of the hollow drum where the fan is located generating a signal indicative of a temperature exceeding the second predetermined threshold and the other temperature sensor generating a signal indicative of a temperature that is equal to or below the second predetermined threshold.

10. The drum assembly of claim 1 further comprising:

an airflow director positioned to receive air flow from the fan and to direct the air flow along the longitudinal axis of the hollow drum.

11. A method for cooling a heated image receiving member comprising:

detecting a temperature at a first portion of a heated image receiving member exceeding a predetermined temperature threshold;

detecting a temperature at a second portion of the heated image receiving member exceeding the predetermined temperature threshold;

alternating operation of a fan directing air through the heated image receiving member between a first speed and a second speed for predetermined periods of time in response to the first portion of the heated image receiving member and the second portion of the heated image receiving member being detected as having a temperature exceeding the predetermined temperature threshold, wherein the first speed is a slow speed that directs air towards the first portion of the heated image receiving member and the second speed is a fast speed that directs air towards the second portion of the heated image receiving member.

12. The method of claim 11 further comprising:

operating the fan at the slow speed only in response to a temperature being detected at the first portion of a heated image receiving member that exceeds the predetermined temperature threshold and a temperature being detected at the second portion of the heated image receiving member that is equal to or less than the predetermined temperature threshold.

13. The method of claim 12 further comprising:

operating the fan at the fast speed only in response to a temperature being detected at the second portion of a heated image receiving member that exceeds the predetermined temperature threshold and a temperature being detected at the first portion of the heated image receiving member that is equal to or less than the predetermined temperature threshold.

14. The method of claim 11 further comprising:

operating the fan at the fast speed only in response to a temperature being detected at the second portion of a heated image receiving member that exceeds the predetermined temperature threshold and a temperature being detected at the first portion of the heated image receiving member that is equal to or less than the predetermined temperature threshold.

15. The method of claim 11 further comprising:

turning off the fan in response to a temperature being detected at the first portion of the heated image receiving member that is less than or equal to the predetermined temperature threshold and a temperature being detected at the second portion of the heated image receiving member that is less than or equal to the predetermined temperature threshold.

16. A printer comprising:

a rotatable image receiving member having a circumferential wall that defines an outer boundary for an internal cavity, the rotatable image receiving member having a first end and a second end and a longitudinal axis about which the rotatable image receiving member rotates;

at least two stationary heaters that are located proximate the circumferential wall to heat the circumferential wall passing by the heaters, one of the two stationary heaters being located near one end of the rotatable image receiving member and the other stationary heater being located near the other end of the rotatable image receiving member; a fan located at one of the two ends of the rotatable image receiving member and configured to direct air through the rotatable image receiving member;

a fan shroud mounted to the fan, the fan shroud having an extension to collect and direct air discharged by the fan along the longitudinal axis of the rotatable receiving member;

at least two temperature sensors, one temperature sensor being proximate one of the two ends of the rotatable image receiving member, and the other temperature sensor being proximate the other of the two ends of the rotatable image receiving member, each temperature sensor generating a signal indicative of a temperature proximate the temperature sensor; and a controller coupled to the heaters, the fan, and the two temperature sensors, and configured to operate the heaters in response to each temperature sensor generating a signal indicative that a temperature proximate the temperature sensor is less than a first predetermined temperature threshold, and to operate the fan at one of at least three speeds in response to a predetermined relationship between the two temperature signals generated by the temperature sensors and a second predetermined temperature threshold.

17. The printer of claim 16 wherein the controller alternates operation of the fan between a slow speed and a high speed for predetermined periods of time in response to both temperature sensors generating a temperature signal indicative of a temperature exceeding the second predetermined threshold.

18. The printer of claim 17 wherein the controller is configured to operate the fan at a slow speed in response to the temperature sensor located at the end of the rotatable image receiving member where the fan is located generating a signal indicative of a temperature exceeding the second predetermined threshold and the other temperature sensor generating a signal indicative of a temperature that is equal to or below the second predetermined threshold.

19. The printer of claim 18 wherein the controller operates the fan at a fast speed in response to the temperature sensor located at the end of the rotatable image receiving member where the fan is located generating a signal indicative of a temperature equal to or less than the second predetermined threshold and the other temperature sensor generates a signal indicative of a temperature exceeding the second predetermined threshold.

* * * * *